US008448997B2

(12) United States Patent
Laliberte et al.

(10) Patent No.: US 8,448,997 B2
(45) Date of Patent: May 28, 2013

(54) SLIDING DOOR LOCK WITH DUAL BREAK-OUT RELEASE

(75) Inventors: Ronald R. Laliberte, Prospect, CT (US); Peter Deleonardis, Burlington, CT (US); Michael Robert Barone, Amston, CT (US); Michael Arthur Salvietti, Northfield, CT (US); Blair Eugene Donewald, Wallingford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 334 days.

(21) Appl. No.: 12/691,043

(22) Filed: Jan. 21, 2010

(65) Prior Publication Data

US 2011/0173891 A1 Jul. 21, 2011

(51) Int. Cl.
*E05B 65/10* (2006.01)
*E05C 7/06* (2006.01)
*E05C 19/00* (2006.01)

(52) U.S. Cl.
USPC ..... 292/92; 49/116; 49/394

(58) Field of Classification Search
USPC ..... 292/4, 32, 37, 57, 137, 159, 139, 292/140, DIG. 46, 92; 70/95, 96, 97, 98, 70/99, 100, DIG. 65; 49/116, 118, 394, 395
See application file for complete search history.

(56) References Cited

U.S. PATENT DOCUMENTS

| | | | | |
|---|---|---|---|---|
| 897,948 | A | 9/1908 | Windsor | |
| 1,054,978 | A | 3/1913 | Meyer | |
| 1,490,777 | A * | 4/1924 | La Fortune | 292/166 |
| 3,271,901 | A | 9/1966 | Bednar | 49/17 |
| 3,582,122 | A | 6/1971 | Foster et al. | |
| 3,640,559 | A * | 2/1972 | Royer | 292/288 |
| 3,678,716 | A | 7/1972 | Cobb | 70/92 |
| 3,768,847 | A | 10/1973 | Buck, Jr. et al. | 292/179 |
| 3,782,034 | A | 1/1974 | Lynn et al. | 49/13 |
| 3,858,920 | A | 1/1975 | Erickson | |
| 4,015,866 | A * | 4/1977 | Marsh et al. | 292/36 |
| 4,204,369 | A * | 5/1980 | Hubbard | 49/319 |
| 4,225,163 | A | 9/1980 | Hubbard et al. | |
| 4,621,451 | A | 11/1986 | Bruehler | 49/15 |
| 4,630,853 | A | 12/1986 | Bell | 292/258 |
| 4,652,027 | A | 3/1987 | Quantz | 292/201 |
| 4,667,990 | A | 5/1987 | Quantz | 292/201 |
| 4,819,379 | A | 4/1989 | Kenzelmann et al. | 49/280 |
| 4,872,284 | A | 10/1989 | Bentley | 49/16 |
| 4,882,876 | A | 11/1989 | Daugirdas | 49/141 |
| 4,984,385 | A * | 1/1991 | DeLand | 49/280 |
| 5,120,094 | A * | 6/1992 | Eaton et al. | 292/159 |
| 5,140,173 | A * | 8/1992 | Chau et al. | 307/125 |
| 5,422,552 | A | 6/1995 | Parisi | 318/466 |
| 5,486,026 | A | 1/1996 | Borgardt | 292/71 |
| 5,564,759 | A * | 10/1996 | McNutt | 292/139 |

(Continued)

FOREIGN PATENT DOCUMENTS

| | | |
|---|---|---|
| DE | 4006593 | 9/1990 |
| EP | 1 013 553 | 6/2000 |

*Primary Examiner* — Thomas Beach
*Assistant Examiner* — Nathan Cumar
(74) *Attorney, Agent, or Firm* — Richard J. Veltman; John D. DelPonti

(57) ABSTRACT

Apparatus and system comprising a release assembly configured to unlock a sliding door panel from left and right sides of the sliding door panel. The left and right sides of the sliding door panel are opposed in the sliding direction.

12 Claims, 17 Drawing Sheets

U.S. PATENT DOCUMENTS

| | | | | |
|---|---|---|---|---|
| 5,581,944 | A | 12/1996 | Kornbrekke et al. | 49/28 |
| 5,634,297 | A | 6/1997 | Ito | 49/360 |
| 5,656,899 | A | 8/1997 | Kuroda | |
| 5,722,202 | A | 3/1998 | Cooper | |
| 5,755,060 | A | 5/1998 | Zweili | |
| 6,009,668 | A | 1/2000 | Reddy | |
| 6,526,695 | B1 | 3/2003 | Nguyen | 49/141 |
| 6,585,303 | B1 | 7/2003 | Coose et al. | 292/144 |
| 6,722,711 | B2 | 4/2004 | Kitzis | |
| 6,793,253 | B2 * | 9/2004 | Bruwer et al. | 292/144 |
| 7,254,918 | B2 * | 8/2007 | Fronz et al. | 49/122 |
| 7,992,346 | B2 | 8/2011 | Finke | |
| 2002/0053166 | A1 * | 5/2002 | Fries | 49/213 |
| 2006/0180405 | A1 | 8/2006 | Eisenhower, Jr. et al. | 187/331 |
| 2007/0056338 | A1 * | 3/2007 | Sabo et al. | 70/257 |
| 2009/0284024 | A1 | 11/2009 | Deleonardis et al. | 292/145 |
| 2010/0031857 | A1 * | 2/2010 | Dunstan | 109/74 |

* cited by examiner

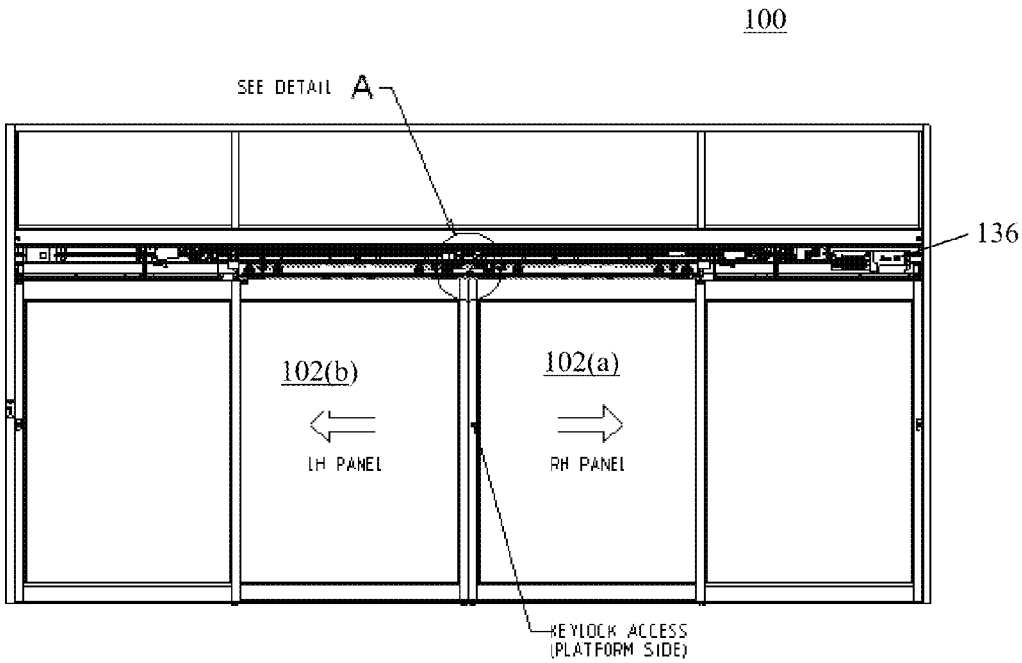
Fig. 1 PLATFORM SIDE ELEVATION
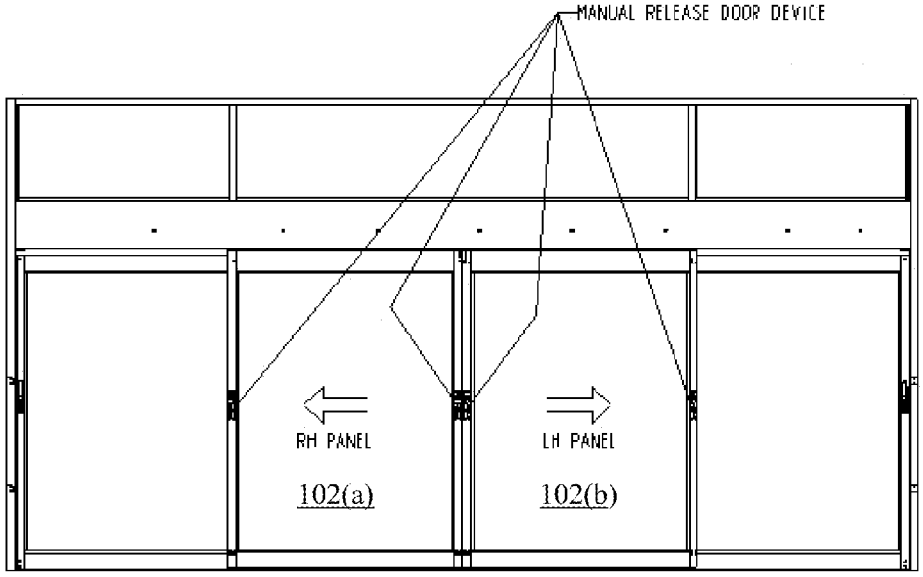
Fig. 2 TRAIN SIDE ELEVATION

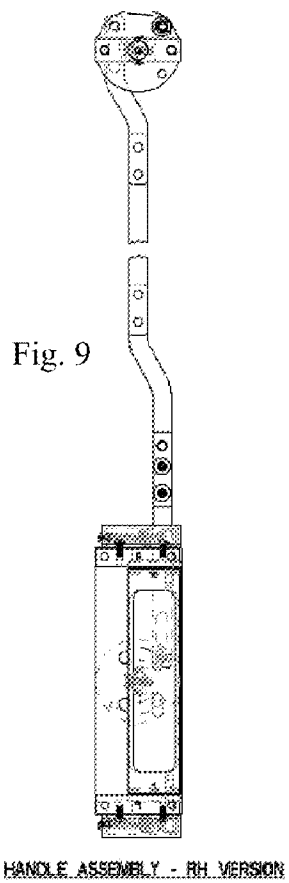
Fig. 6
Fig. 7
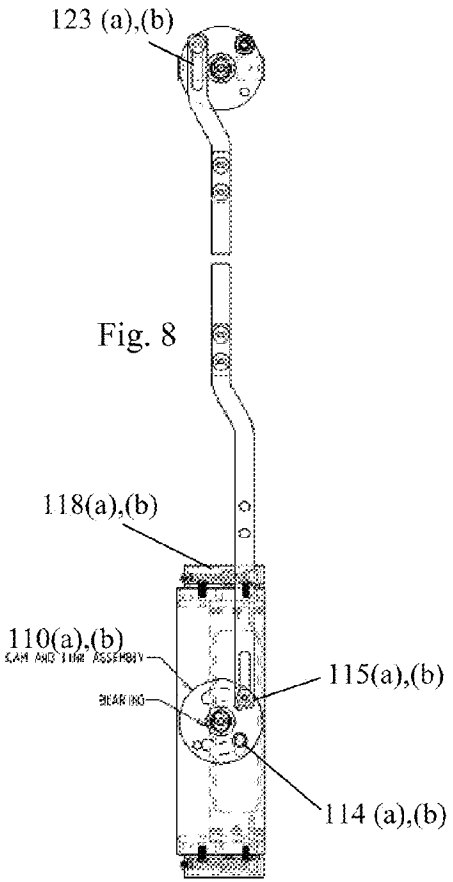
Fig. 8
Fig. 9

PLATFORM SIDE ELEVATION

SLIDING DOOR LOCK WITH DUAL BREAK-OUT RELEASE

RELATED APPLICATIONS

This application is related to U.S. patent application Ser. No. 12/467,154, filed May 15, 2009, the contents of which are incorporated by reference in their entirety.

FIELD OF THE INVENTION

The present invention relates to release mechanisms, and more particularly to release mechanisms configured to unlock doors such as slidable doors.

BACKGROUND OF THE INVENTION

Sliding doors are commonly used in commercial buildings, airports, and the like. Such sliding doors typically have one or more doors carried in a surrounding frame (e.g., made of metal or wood) adapted for sliding movement back and forth upon a track or a rail. These sliding doors provide convenient access for ingress and egress. For some applications it is desirable to secure these sliding doors with a lock to prevent unauthorized entry. In other applications, it is desirable to have sliding doors with sensors that determine if the doors are closed and locked and provide a warning signal if the doors are not closed and/or locked.

The sliding doors used in commercial buildings, airports, etc. are typically motor driven, usually by an electric motor. Should the power fail, the sliding doors may be locked in a closed position. To allow egress in the event of a power failure, conventional sliding doors may include a mechanical release assembly which disengages the lock and allows the sliding door to be opened.

Conventional release mechanisms, however, may sometimes be inaccessible to the user. For example, an airport shuttle train traveling between terminals should stop in essentially the same spot in the terminals so that the train doors align with the terminal's sliding doors. The train, however, may stop either before or past the desired spot. In this situation, the release mechanism may be inaccessible.

SUMMARY OF THE INVENTION

An embodiment of the invention relates to an apparatus comprising a release assembly configured to unlock a sliding panel from first and second sides of the sliding panel, wherein the first and second sides of the sliding panel are opposed in the sliding direction. In one aspect, the release assembly comprises a first handle, a first vertical linkage operably attached to the first handle, a second a handle, a second vertical linkage operably attached to the second handle, and a horizontal linkage operably attached to the first and second linkages. In another aspect, the first vertical linkage is operably attached to the first handle with a first handle cam, the second vertical linkage is operably attached to the second handle with a second handle cam, the first vertical linkage is operably attached to the horizontal linkage with a first linkage cam, and the second vertical linkage is operably attached to the horizontal linkage with a second linkage cam.

In another aspect, the release assembly is configured to be operated independently from the first side or the second side of the panel. In another aspect, the release assembly comprises a first switch adjacent to the first side of the panel and a second switch adjacent to the second side of the panel and a solenoid operable connected to the first and second switches and further configured to unlock a lock.

Another embodiment of the invention relates to a system comprising a sliding panel; a lock having a release mechanism, the lock configured to lock the sliding panel; and a release assembly, the release assembly configured to unlock the lock from first and second sides of the sliding panel, wherein the first and second sides of the sliding panel are opposed in the sliding direction. In one aspect, the system comprises a plurality of panels. In another aspect, each of the panels is configured with a release mechanism. In another aspect, the release assembly comprises a first handle, a first vertical linkage operably attached to the first handle, a second a handle, a second vertical linkage operably attached to the second handle, and a horizontal linkage operably attached to the first and second linkages.

In another aspect, a first vertical linkage is operably attached to the first handle with a first handle cam, the second vertical linkage is operably attached to the second handle with a second handle cam, the first vertical linkage is operably attached to the horizontal linkage with a first linkage cam, and the second vertical linkage is operably attached to the horizontal linkage with a second linkage cam. In another aspect, the release assembly is configured to be operated independently from the first side and the second side of the panel. In another aspect, the system further comprises at least one sensor configured to determine if the panel is unlocked. In another aspect, the system further comprises a sensor to determine if the panel is in an open position. In another aspect, the release assembly comprises a first switch adjacent to the first side of the panel and a second switch adjacent to the second side of the panel and a solenoid operable connected to the first and second switches and further configured to unlock a lock.

Another embodiment of the invention relates to a method of manually unlocking a sliding panel comprising operating a release mechanism, the release assembly configured to unlock a sliding panel from first and second sides of the sliding panel, wherein the first and second sides of the sliding panel are opposed in the sliding direction. In one aspect, operating a release mechanism comprises moving a handle. In another aspect, operating a release mechanism comprises activating a switch. In another aspect, the release assembly comprises a first handle adjacent the first side of the panel and a second handle adjacent the second side of the panel and the first and second handles operate independently. In another aspect, the method further comprises providing a warning signal if the lock is in an locked or unlocked position.

Another embodiment relates to door panel assembly comprising a slidable panel movable between close and open position, the panel comprising a frame with first and second stiles positioned on opposite sides of the panel; a drive motor arranged to move the panel between the open and closed positions; a lock arranged to lock the panel in the close position; and a release assembly configured to unlock the lock, the release assembly comprising a first manually engageable release actuator on the first stile and a second manually engageable release actuator on the second stile.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In an optional embodiment, the drawings herein can be considered drawn to scale. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

FIG. 1 is a side elevation view of an embodiment of the present invention from the vantage of a platform.

FIG. 2 is a side elevation view of an embodiment of the present invention from the vantage of a train.

FIG. 6 is a detailed view of the portion labeled A in FIG. 4.

FIG. 7 is the view of FIG. 6 rotated 90 degrees.

FIG. 8 is the view of FIG. 6 rotated 180 degrees.

FIG. 9 is a detailed view of the portion labeled B in FIG. 4.

DETAILED DESCRIPTION

Embodiments of the invention include a dual release apparatus that may be used to unlock a sliding door. Alternatively, the dual release apparatus may be used to unlock two or more sliding doors. In some embodiments, the dual release apparatus includes two handles configured to manually unlock the sliding door. The two handles may be attached on to stiles on opposite sides of the sliding door, allowing the sliding door to be unlocked from either side of the door. In some embodiments, the dual release apparatus includes a sensor configured to determine if the panel is unlocked. The dual release apparatus may also include a sensor to determine if the panel is in an open position.

Figure 3:
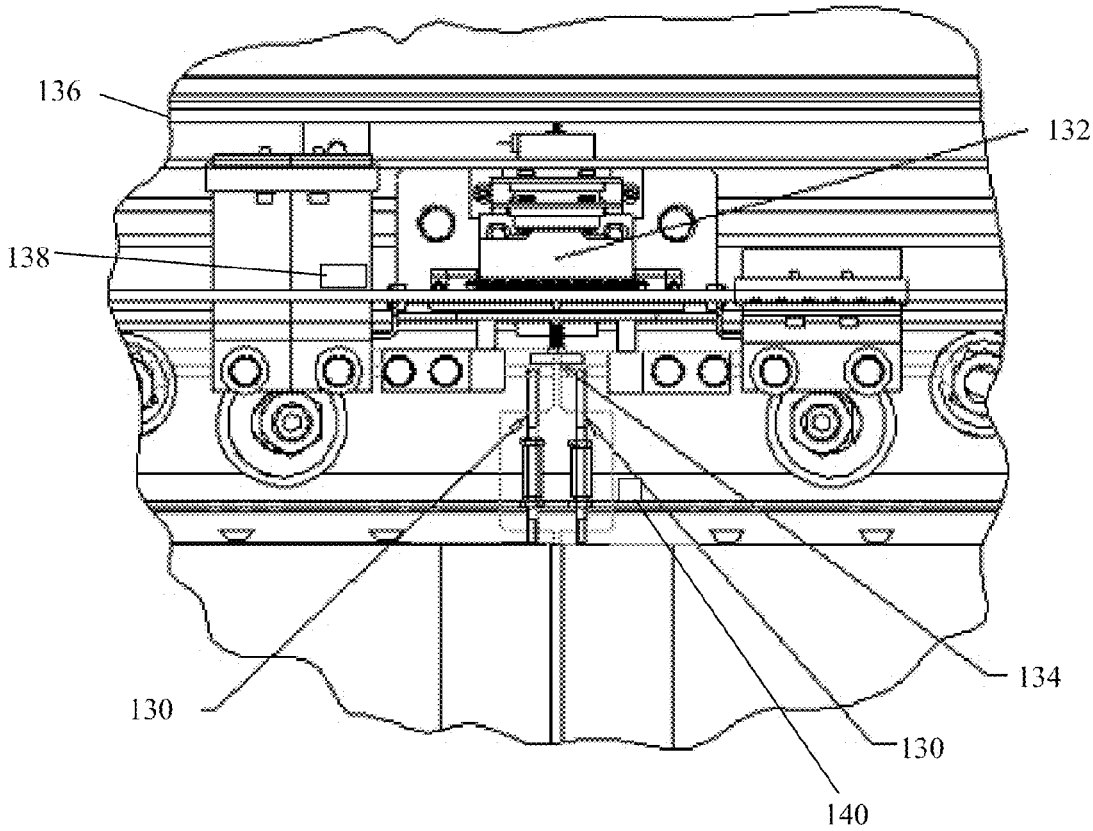
FIG. 3 is a detailed view of the portion labeled A of the embodiment illustrated in FIG. 1.
Figure 4:
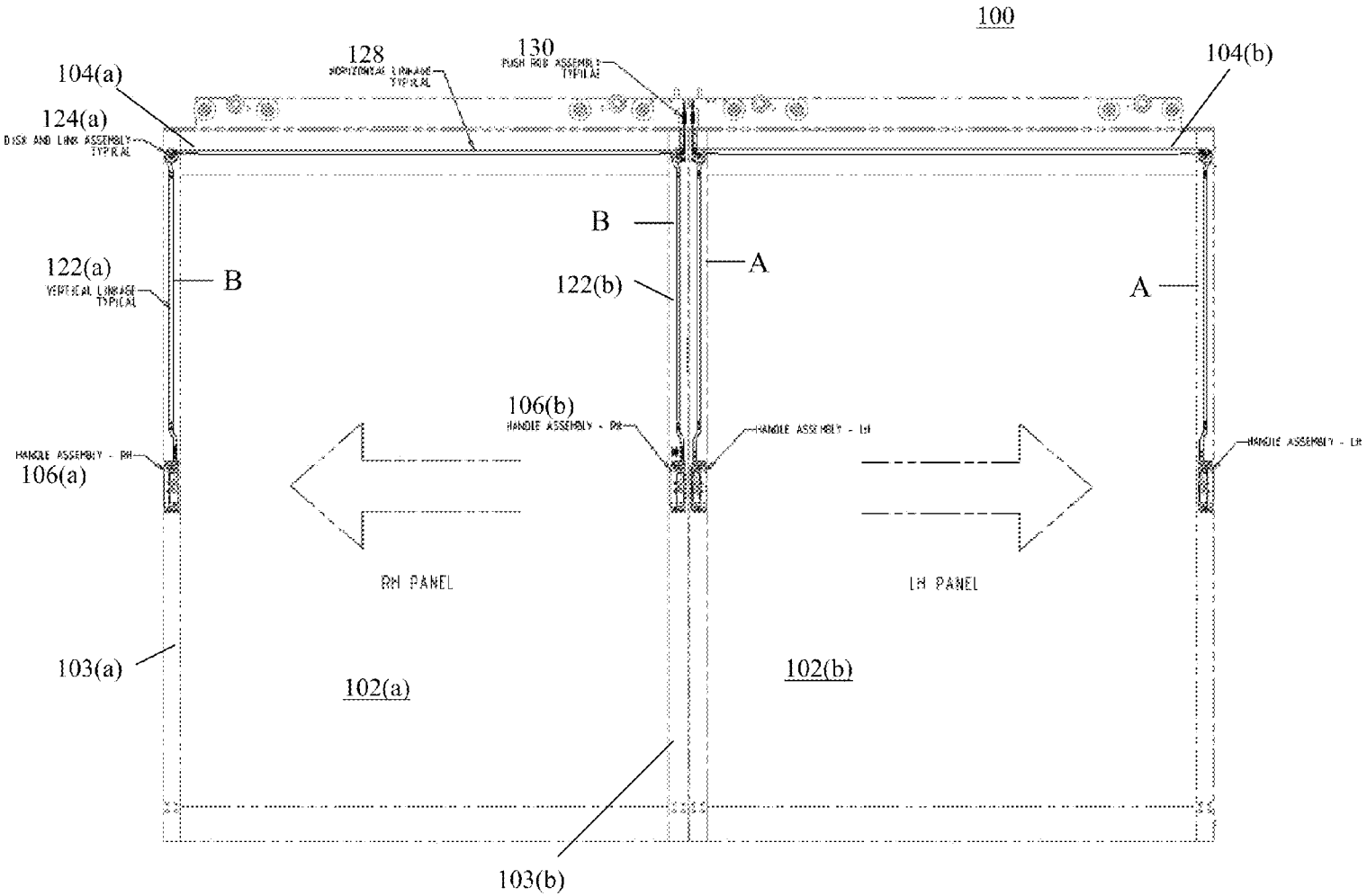
FIG. 4 is an enlarged view of FIG. 2 showing more details.
Figure 5:
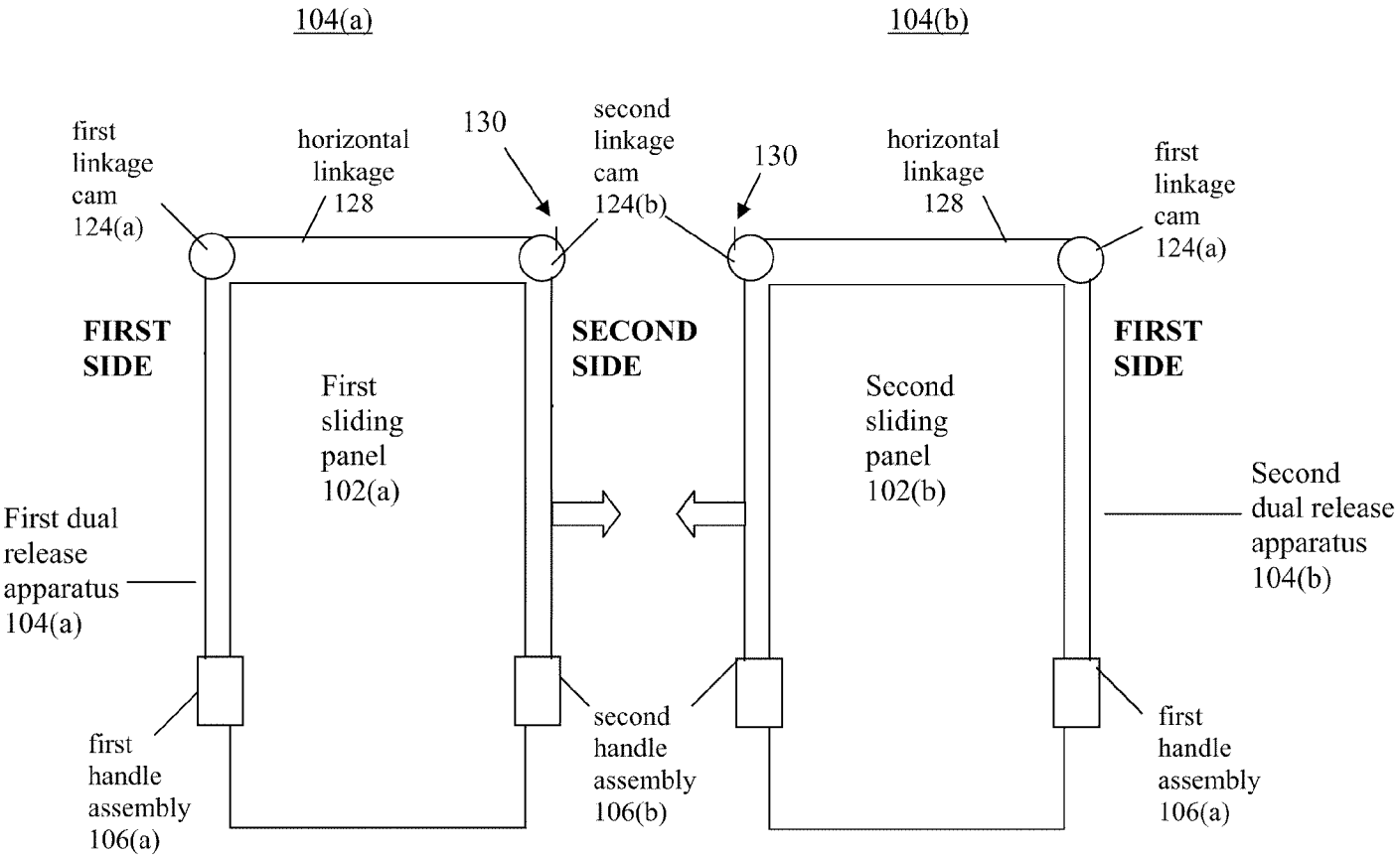
FIG. 5 is a schematic view of the embodiment illustrated in FIG. 4.
Figure 10:
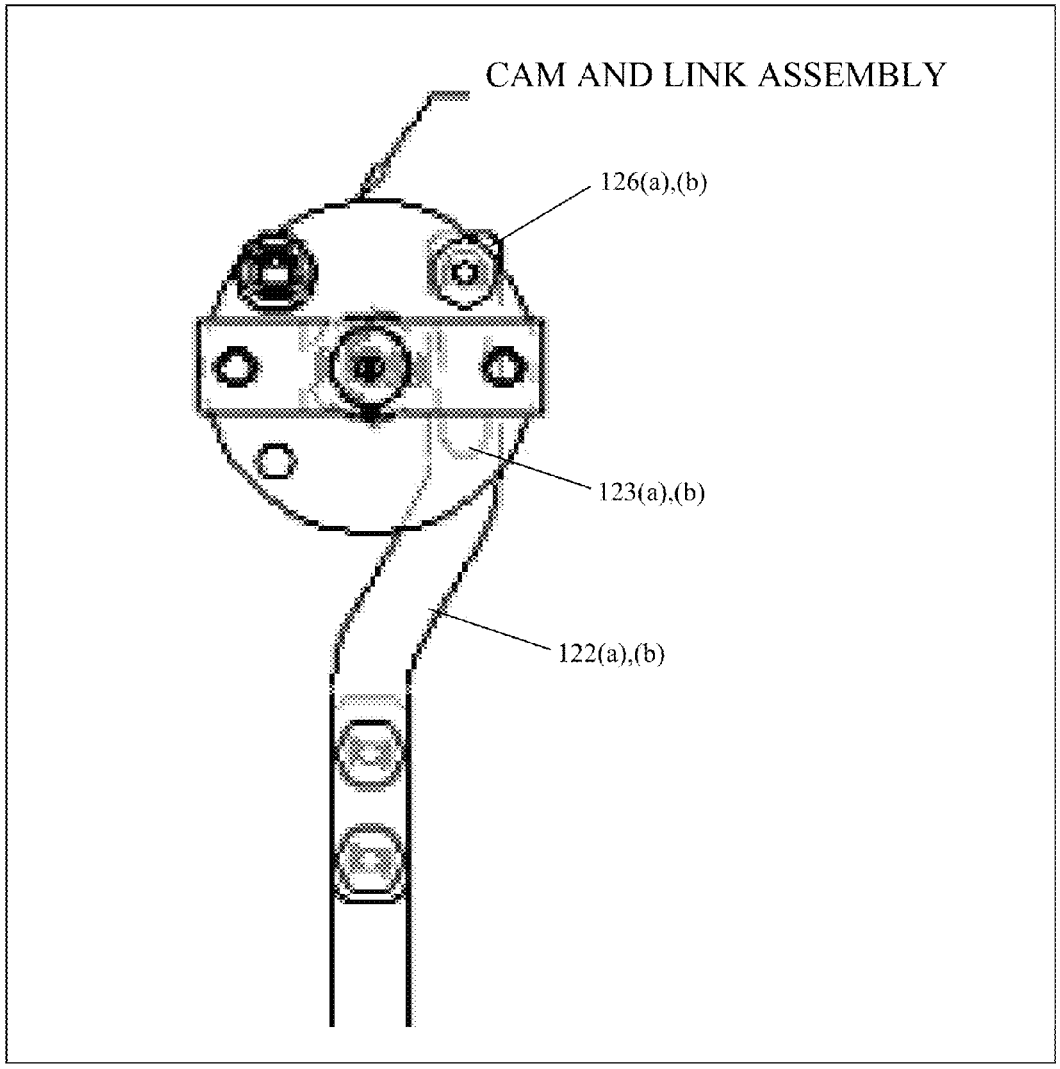
FIG. 10 is a partial view showing a dose up of a portion of the embodiment illustrated in FIG. 6.
Figure 11:
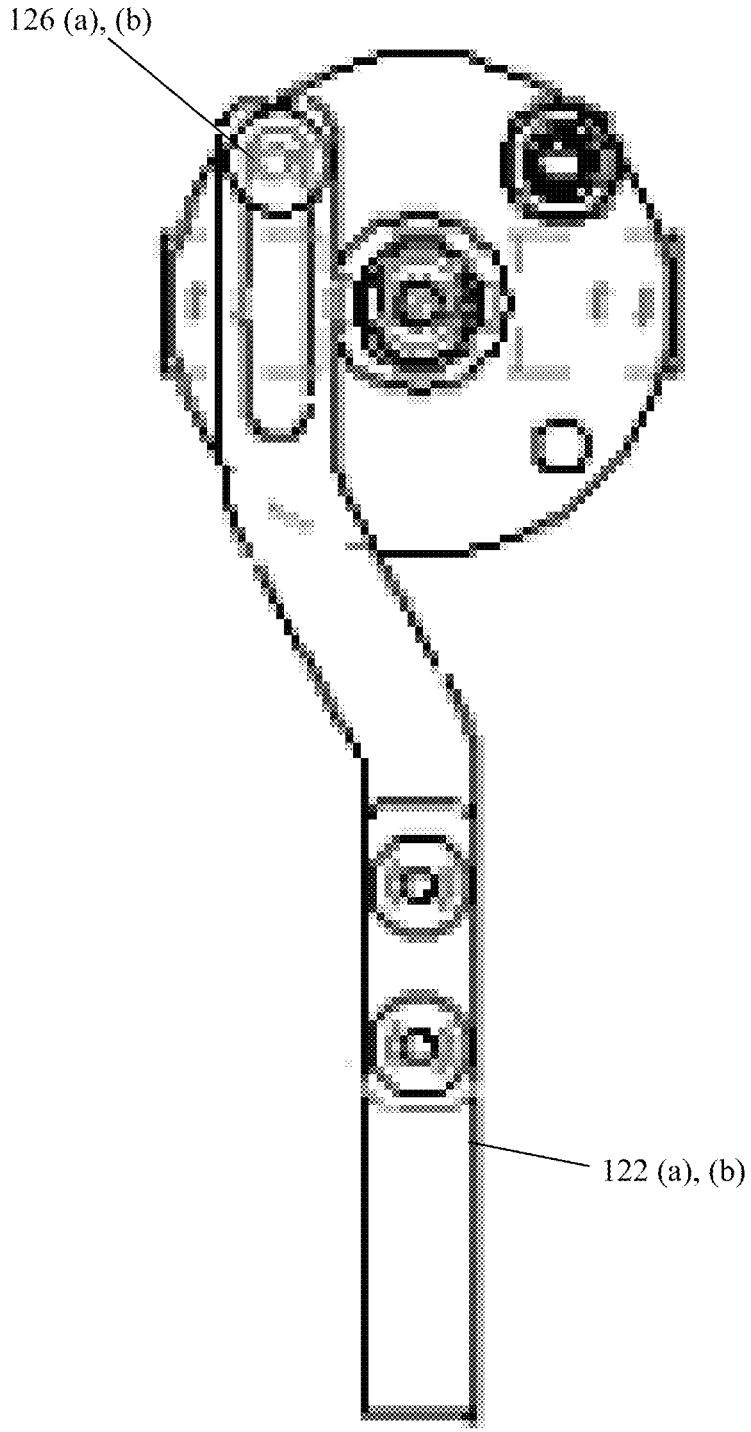
FIG. 11 is a s partial view showing a close up of a portion of the embodiment illustrated in FIG. 8.
Figure 20:
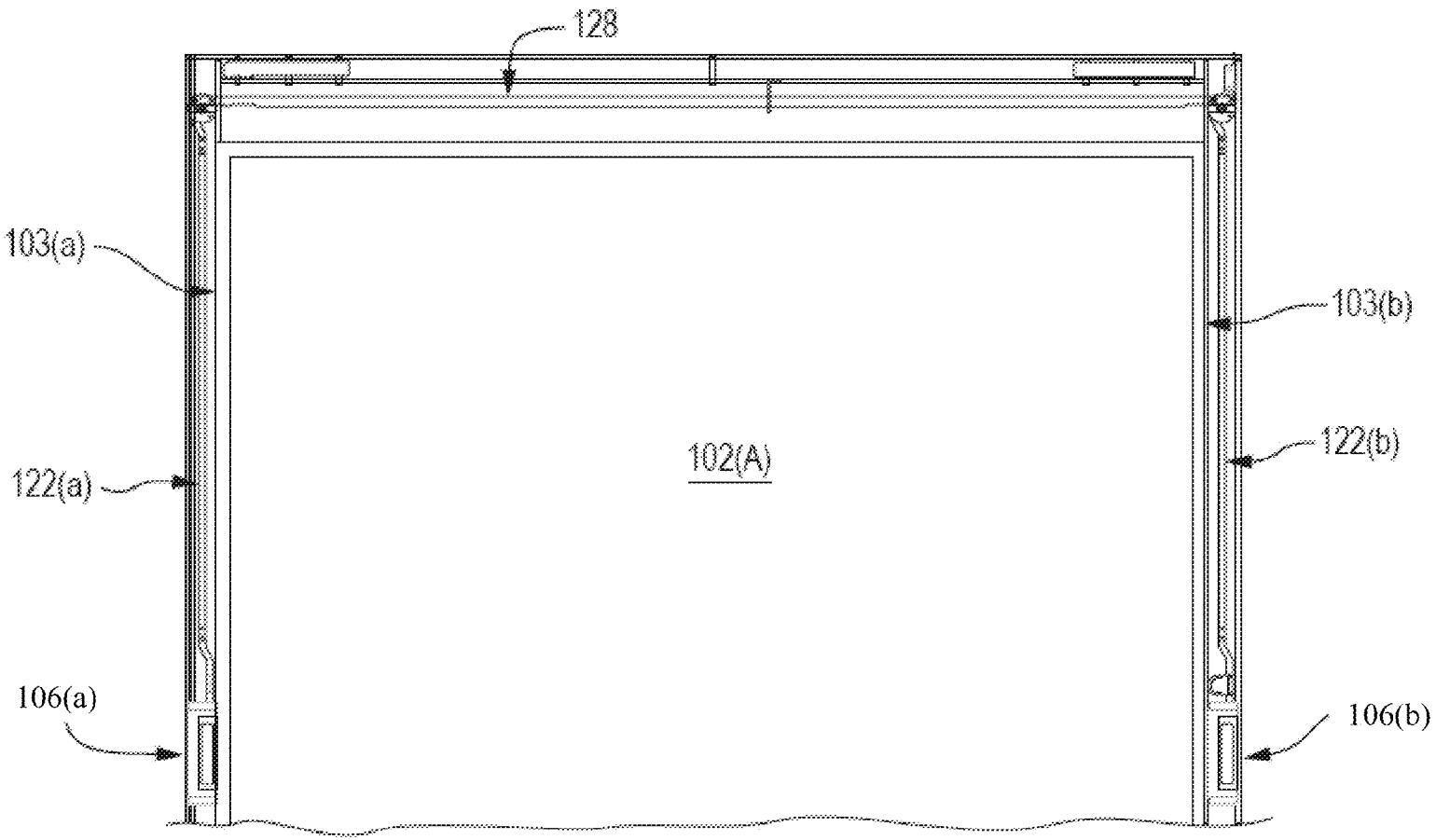
FIG. 20 is a detailed view of the left half of FIG. 4.

FIGS. 1-20 illustrate a dual release system 100 and a dual release apparatus 104(*a*), 104(*b*) according to one or more embodiments of the invention. FIG. 1 illustrates a side elevation view of an embodiment of the present invention from the vantage of a platform while FIG. 2 illustrates a side elevation view of an embodiment of the present invention from the vantage of a train. FIG. 4 is an enlarged view of the embodiment illustrated FIG. 2 while FIG. 5 is a schematic illustration of the embodiment illustrated in FIGS. 2 and 4. FIG. 20 is a detailed view of the left half of the embodiment illustrated in FIGS. 2 and 4. Because the directions "left" and "right" depend on where the observer is standing/the direction the observer is looking (e.g., on a train looking out versus on a platform looking in), non-directional "first" and "second" are used in this application rather than "left" and "right."

As illustrated in FIGS. 4 and 5, the system 100 includes two sliding door panels 102(*a*), 102(*b*). In this embodiment, the sliding door panels 102(*a*), 102(*b*) are configured such that when the sliding door panels 102(*a*), 102(*b*) are in a closed position, the second sides of the sliding door panels 102(*a*), 102(*b*) are substantially flush with each other. Opposite the second side of each sliding door panel 102(*a*), 102(*b*) is the first side. The sliding door panels 102(*a*), 102(*b*) are moved into an open position by moving the sliding door panels 102(*a*), 102(*b*) in opposite directions, that is, away from each other, as indicated by the arrows in FIG. 4. The sliding door panels 102(*a*), 102(*b*) are moved into a closed position by moving the sliding door panels 102(*a*), 102(*b*) towards each other as indicated by the arrows in FIG. 5.

The illustrated system 100 may include a first sliding door panel 102(*a*) and a second sliding door panel 102(*b*). Alternatively, the system 100 may include only one sliding door panel 102(*a*). Each sliding door panel 102(*a*), 102(*b*) may include a dual release apparatus 104(*a*), 104(*b*). Typically, each sliding door panel 102(*a*), 102(*b*) includes a first stile 103(*a*) and a second stile 103(*b*), the stiles 103(*a*), 103(*b*) being located on opposite sides of the sliding door panels 102(*a*), 102(*b*) in the sliding direction.

Figure 14:
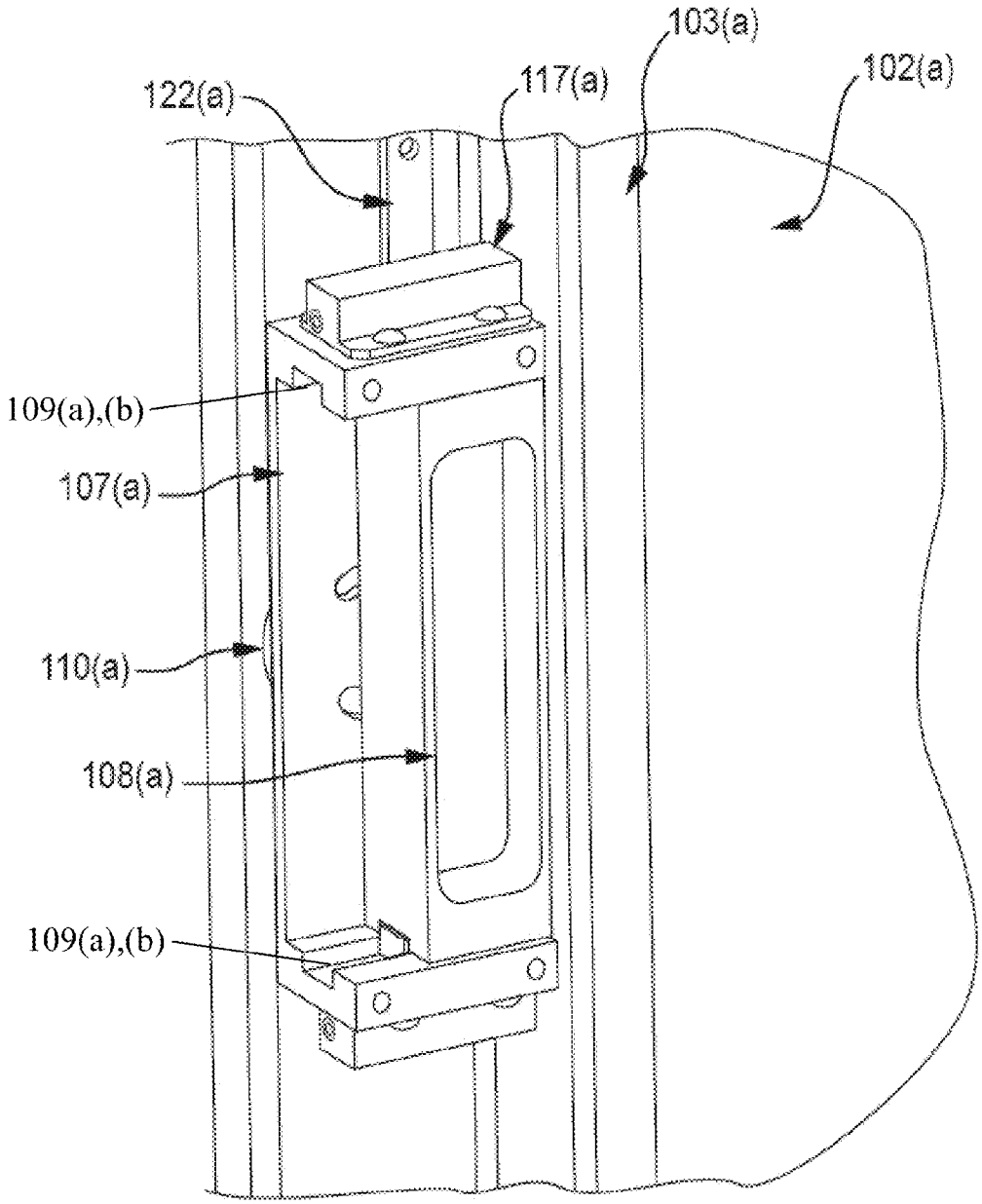
FIG. 14 is a perspective view of a handle assembly according to an embodiment of the invention.

Each of the illustrated a dual release apparatuses 104(*a*), 104(*b*) includes a first handle assembly 106(*a*) and second handle assembly 106(*b*) (FIGS. 4, 5, 20). The first and second handle assemblies 106(*a*), 106(*b*) are typically mounted on opposite stiles 103(*a*), 103(*b*). (FIGS. 2, 4, and 14). The first and second handle assemblies 106(*a*), 106(*b*) may be mounted on the stiles 103(*a*), 103(*b*) with screws or bolts or any other suitable mounting method such as adhesives, welding, or brazing. Each handle assembly 106(*a*), 106(*b*) includes a housing 107(*a*), 107(*b*) (FIGS. 14-16), a handle 108(*a*), 108(*b*), a handle cam 110(*a*), 110(*b*) and a return spring assembly 116(*a*), 116(*b*). In the illustrated embodiment, the handle 108(*a*), 108(*b*) is slidably mounted in slots 109(*a*),(*b*) in the housing 107(*a*), 107(*b*). Further, the housing 107(*a*), 107(*b*) include two arcuate slots, an upper arcuate slot 112(*u*) and a lower arcuate slot 112(*l*). The handle cams 110(*a*), 110(*b*) are circular and rotatable about a central pin 111(*a*),(*b*) connected between the handle cams 110(*a*), 110(*b*) and the associated housing 107(*a*), 107(*b*).

Figure 15:
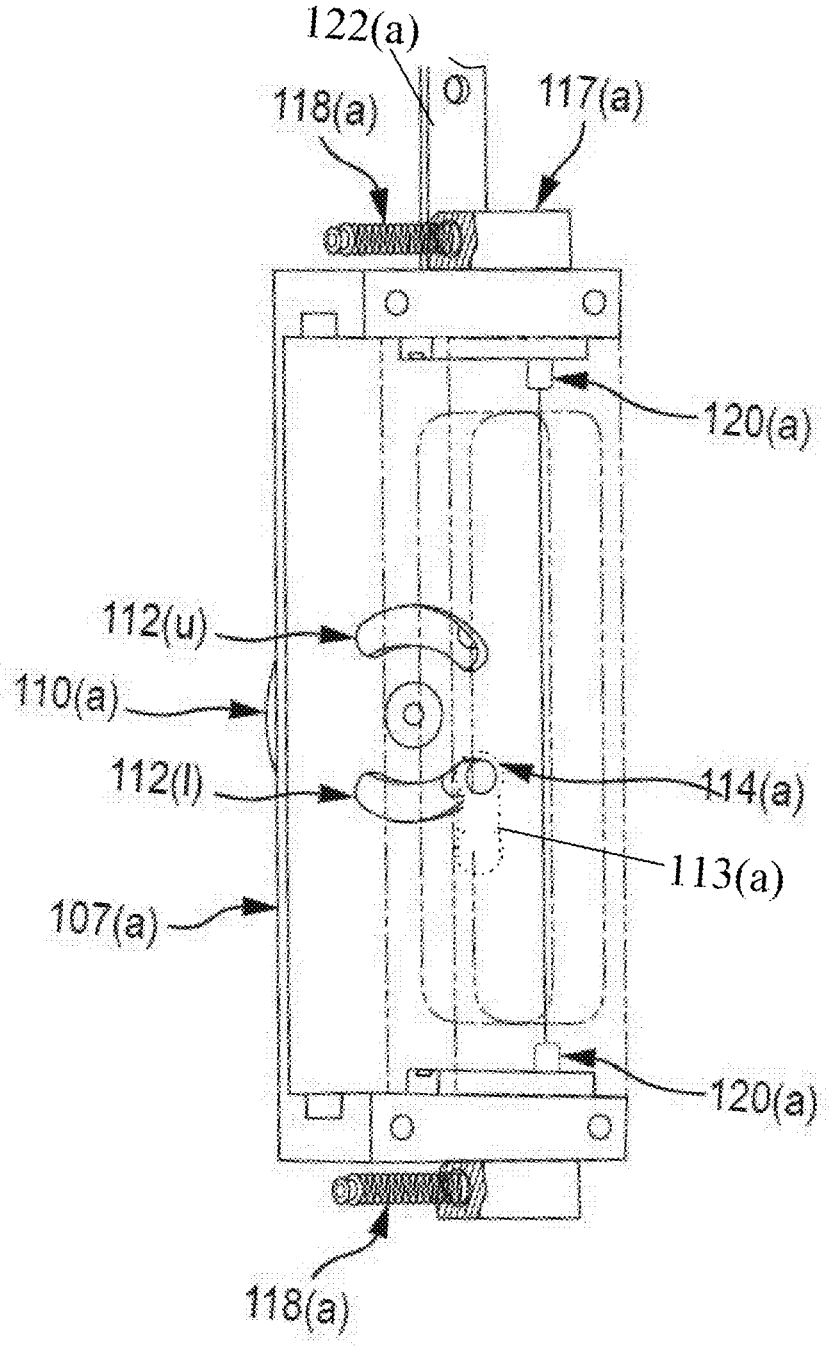
FIG. 15 is a perspective view of a portion of a handle assembly according to an embodiment of the invention.

Connected to the handle cams 110(*a*), 110(*b*) and protruding through the lower arcuate slot 112(*l*) are connection rods 114(*a*), 114(*b*) (FIG. 15). The connection rods 114(*a*), 114(*b*) connect the handles 108(*a*), 108(*b*) to the handle cams 110(*a*), 110(*b*). The connection rods 114(*a*), 114(*b*) are connected to the handles 108(*a*), 108(*b*) via an elongated slot 113(*a*), 113(*b*) in the back of the handles 108(*a*), 108(*b*). The connection rods 114(*a*), 114(*b*) are mounted off the center of the axis of rotation of the handle cams 110(*a*), 110(*b*). Because the connection rods 114(*a*), 114(*b*) are mounted off center, sliding motion of the handles 108(*a*), 108(*b*), causes the handle cams 110(*a*), 110(*b*) to rotate. The motion of the connection rod 114(*a*), 114(*b*) is limited by the ends of the lower arcuate slot 112(*l*), thereby preventing the handle cams 110(*a*), 110(*b*) from over rotating.

Figure 13:
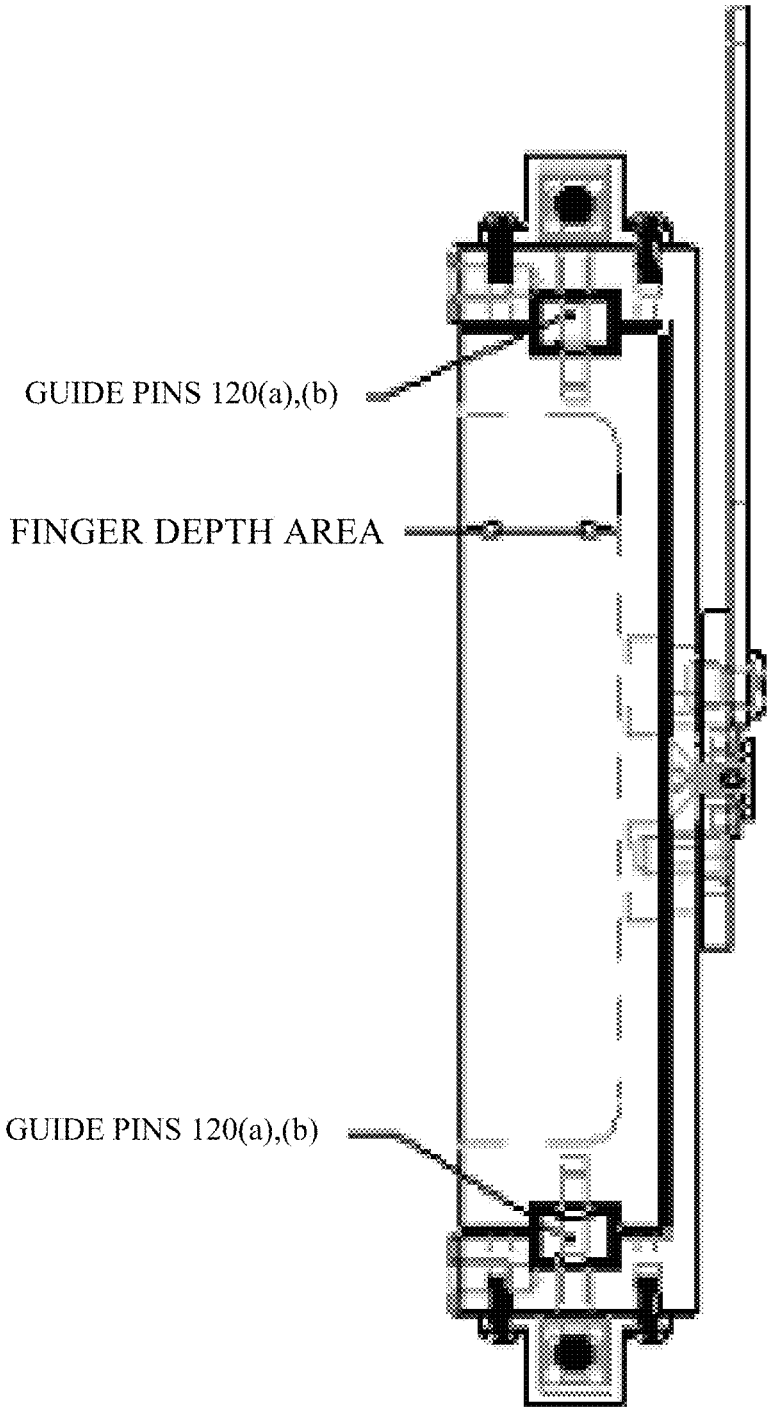
FIG. 13 is a partial view showing a close up of a portion of the embodiment illustrated in FIG. 7.

Return spring assemblies 116(*a*), 116(*b*) include a return spring 118(*a*), 118(*b*), a spring anchor 119(*a*), 119(*b*) (FIG. 15), guide pins 120(*a*), 120(*b*), and a spring housing 117(*a*), 117(*b*). The return spring 118(*a*), 118(*b*), spring anchor 119(*a*), 119(*b*), and guide pins 120(*a*), 120(*b*) are housed in the spring housing 117(*a*), 117(*b*). The spring anchor 119(*a*), 119(*b*) may be affixed to an inner surface of the spring housing 117(*a*), 117(*b*). The spring anchor 119(*a*), 119(*b*) is affixed to the spring housing 117(*a*), 117(*b*) with screws or bolts or any other suitable mounting means such as adhesives, welding, or brazing. One end of the return spring 118(*a*), 118(*b*) is affixed to the spring anchor 119(*a*), 119(*b*) while the other end of the return spring 118(*a*), 118(*b*) is affixed to a first end of the guide pins 120(*a*), 120(*b*). As illustrated in FIGS. 13 and 15, the guide pins 120(*a*), 120(*b*) extend through the 107(*a*), 107(*b*) into the handle 108(*a*), 108(*b*). In addition to securing on end of the return spring 118(*a*), 118(*b*), the guide pins 120(*a*), 120(*b*) assist in guiding the handle 108(*a*), 108(*b*) as it slidably moves from a rest position to an active position.

In one embodiment, the return spring 118(*a*), 118(*b*) is configured such that when the handle 108(*a*), 108(*b*) is in a first, rest position, the return spring 118(*a*), 118(*b*) is in a relaxed state. When a user slides the handle away from the first, rest position to a second, active position (FIGS. 14-16), the return spring 118(*a*), 118(*b*) is stretched, adding energy to the return spring 118(*a*), 118(*b*). When the handle 108(*a*), 108(*b*) is released by the operator, the energy in the stretched return spring 118(*a*), 118(*b*) pulls the handle 108(*a*), 108(*b*) back to its original, rest position. Alternatively, the spring 118(*a*), 118(*b*) may configured to operate in compression. That is, sliding the handle 108(*a*), 108(*b*) from the rest position to the active position squeezes the return spring 118(*a*), 118(*b*), adding compressive energy to the return spring 118(*a*), 118(*b*). When the handle 108(*a*), 108(*b*) is released, the compressive energy in the return spring 118(*a*), 118(*b*) causes the handle 108(*a*), 108(*b*) to move back to the rest position.

Figure 12:
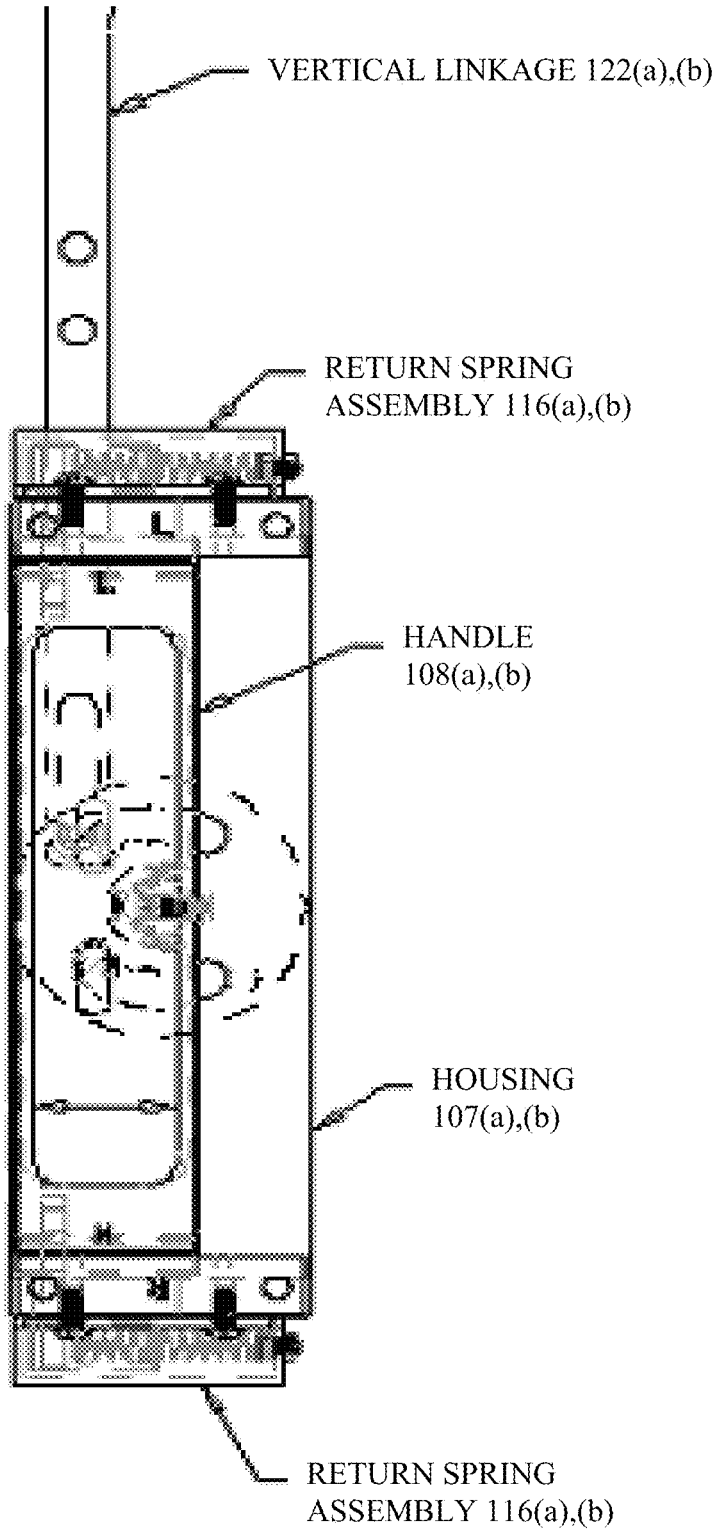
FIG. 12 is a partial view showing a close up of a portion of the embodiment illustrated in FIG. 6.
Figure 16:
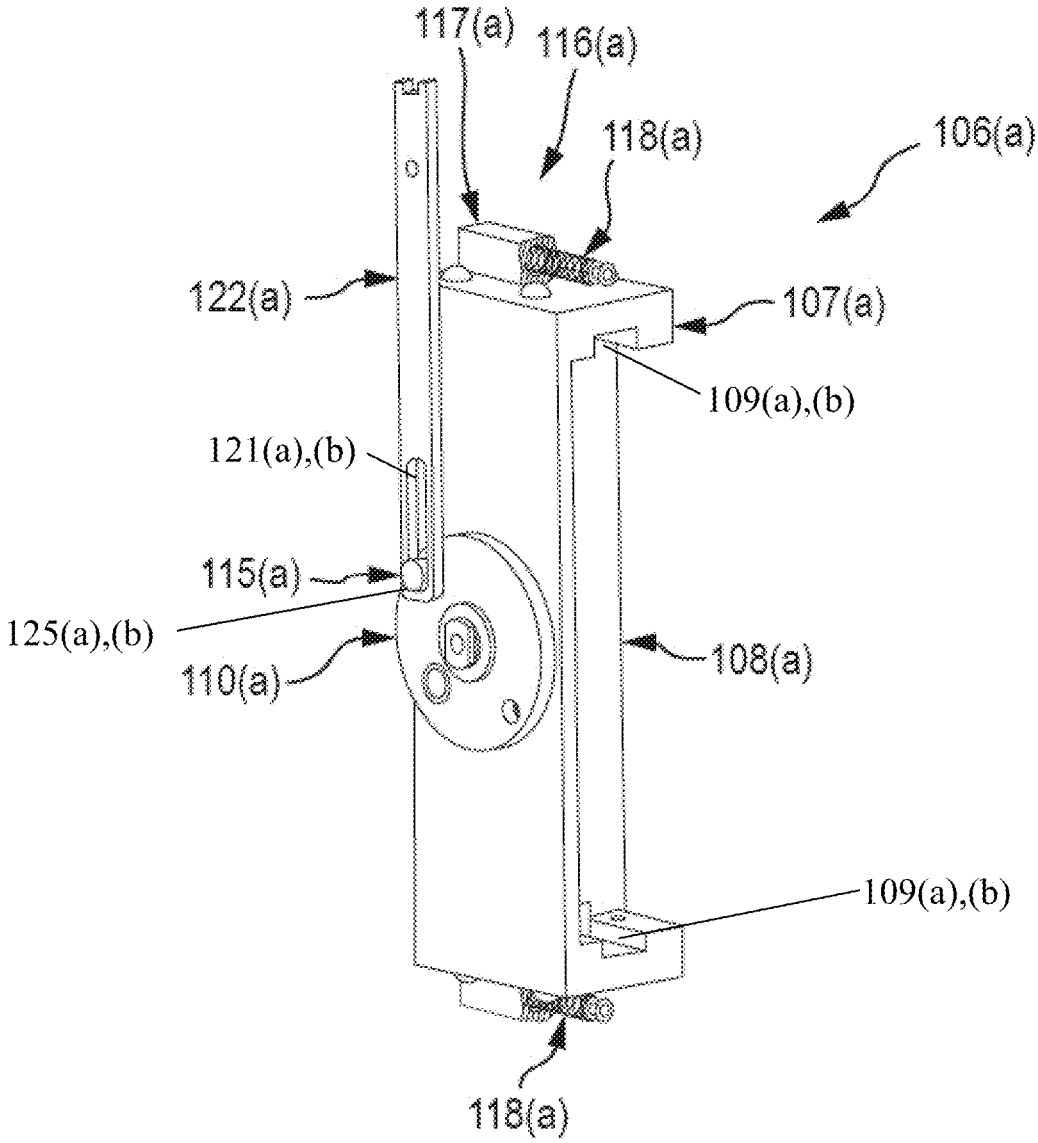
FIG. 16 is a perspective view of the back of a handle assembly according to an embodiment of the invention.
Figure 17:
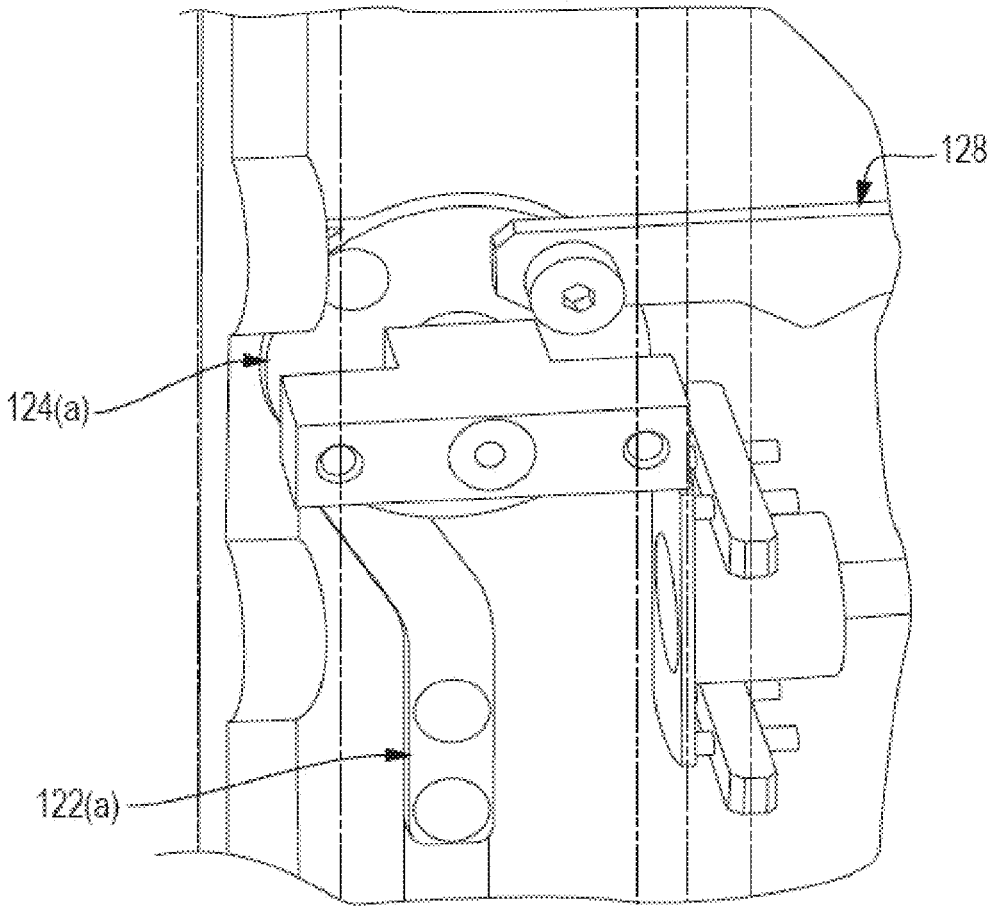
FIG. 17 is a perspective view of a first side linkage and cam of an embodiment of the invention.

As illustrated in FIGS. 4 and 5, each dual release apparatus 104(*a*), 104(*b*) includes first handle assembly 106(*a*) and a second handle assembly 106(*b*). Each of the first handle assembly 106(*a*) and second handle assembly 106(*b*) are operatively connected to a first vertical linkage 122(*a*) and second vertical linkage 122(*b*), respectively (FIGS. 6, 12, 16). In this manner, either of the first handle assembly 106(*a*) or a second handle assembly 106(*b*) may be operated to manually unlock the sliding door panels as discussed in more detail below. The first and second vertical linkages 122(*a*), 122(*b*) are connected to the first and second handle cams 110(*a*), 110(*b*) via lower connecting rods 115(*a*), 115(*b*) (FIG. 16). As shown in FIG. 16, the lower connecting rods 115(*a*), 115(*b*), which extend rearwardly from the handle cams 110(*a*), 110(*b*) (in contrast to connections rods 114(*a*), 114(*b*) which extend forwardly from the handle cams 110(*a*), 110(*b*)), are connected to vertical linkages 122(*a*), 122(*b*) by being received in an elongated slot 121(*a*), 121(*b*). Specifically, lower connecting rods 115(*a*), 115(*b*) engage a lower edge 125(*a*), 125(*b*) of slot 121(*a*), 121(*b*) when cam 110(*a*), 110(*b*) is rotated, so as to pull linkages 122(*a*), 122(*b*) down. Alternatively, the lower connecting rods 115(*a*), 115(*b*) may be replaced with bolts or pins or the like.

Figure 18:
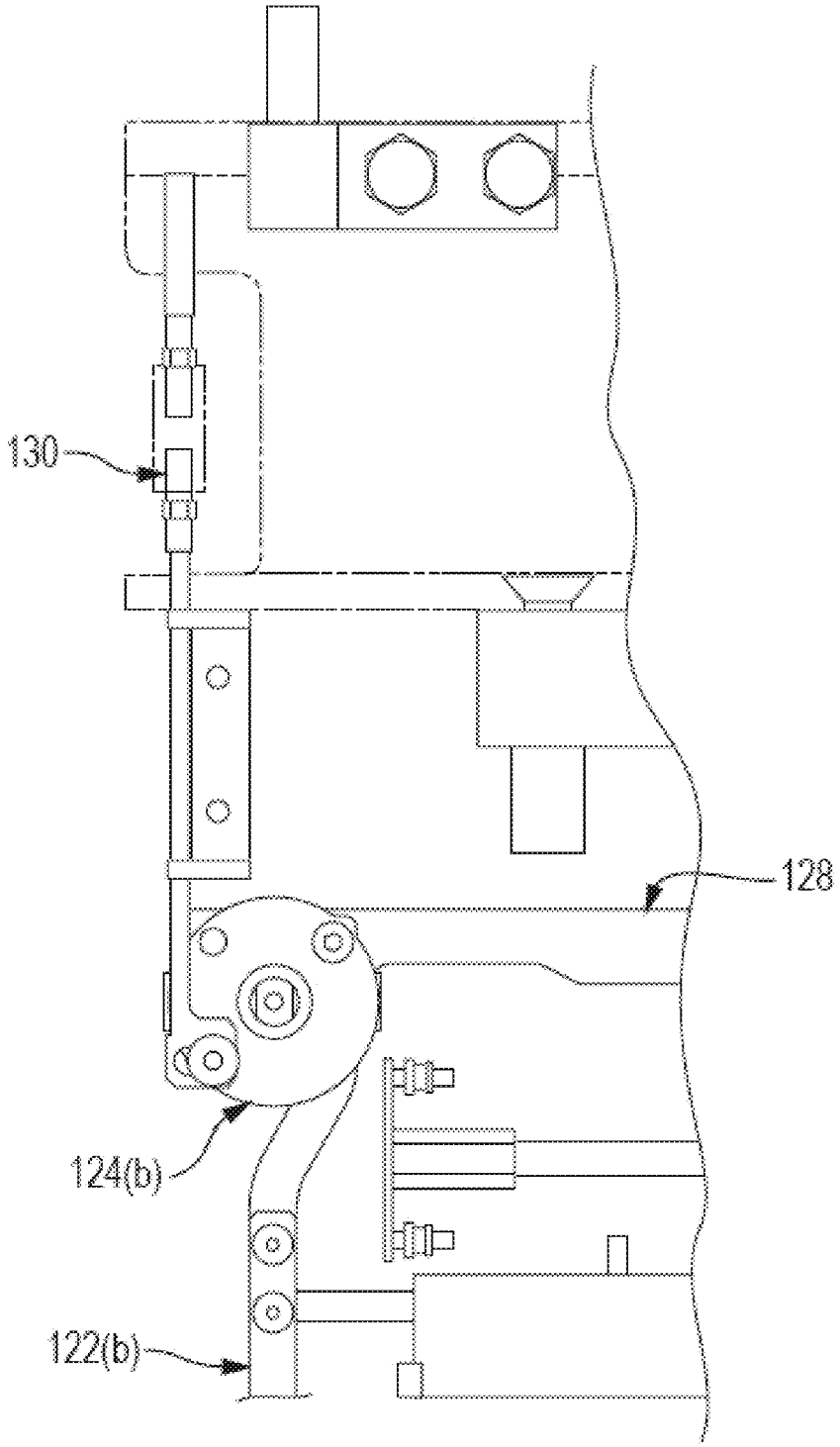
FIG. 18 is a schematic view from the back of a second side linkage and cam of an embodiment of the invention.
Figure 19:
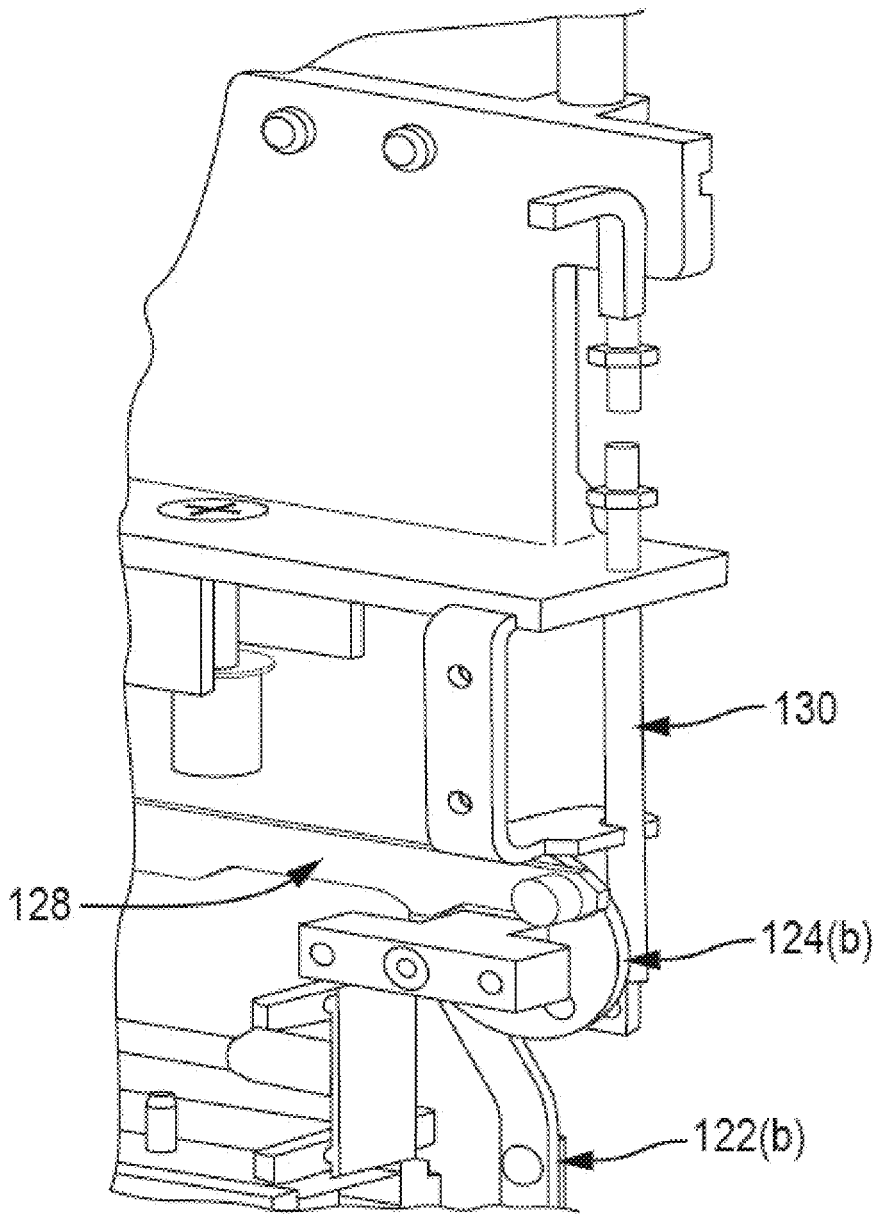
FIG. 19 is a perspective view from the front of the second side linkage and cam illustrated in FIG. 18.

As illustrated in FIGS. 4, 5, 10, 11, an opposite end of the first and second vertical linkages 122(*a*), 122(*b*) are attached to first and second linkage cams 124(*a*), 124(*b*). Connecting rods, bolts, or pins 126(*a*), 126(*b*) are used to connect the vertical linkages 122(*a*), 122(*b*) with the linkage cams 124(*a*), 124(*b*). The rods, bolts, or pins 126(*a*), 126(*b*) are fixed for rotation with the linkage cams 124(*a*), 124(*b*) but extend through linear slots 123(*a*), 123(*b*) in the first and second linkages 122(*a*), 122(*b*). Also attached to the second linkage cam 124(*b*) is a push rod 130 (FIGS. 3, 4, 18). The push rod 130 is configured to protrude above the second linkage cam 124(*b*). Further, the push rod 130 is configured to move in a vertical direction when the second linkage cam 124(*b*) is rotated. That is, the push rod 130 is affixed to the second linkage cam 124(*b*) a predetermined distance from the center of the second linkage cam 124(*b*). The predetermined distance is a function of the degree of rotation of the second linkage cam 124(*b*) and the distance desired to elevate the push rod 130 to activate the lock assembly 132 as discussed below.

The first and second linkage cams 124(*a*), 124(*b*) are operatively connected to each other via a horizontal linkage 128 (FIGS. 4, 5, 17-20). The connection to the horizontal linkage 128 may be with rods, pins, bolts, or other suitable connectors. The connection is operable in the sense that if either of the linkage cams 124(*a*), 124(*b*) is rotated by actuating the associated handle 108(*a*), 108(*b*), the horizontal linkage 128 reciprocates. In this manner, rotation of either of the linkage cams 124(*a*), 124(*b*) (resulting from actuation of either handle 108(*a*), 108(*b*)) will ultimately result in the push rod 130 moving in a vertical direction. For example, if the first linkage cam 124(*a*) is caused to rotate in a counterclockwise direction (for a "left-handed" embodiment), the horizontal linkage 128 will be pulled to the left (see FIG. 18) because the horizontal linkage 128 is affixed to the top of the first linkage cam 124(*a*). Because the horizontal linkage 128 is also affixed to the top of the second linkage cam 124(*b*) (see FIG. 19), the second linkage cam 124(*b*) also rotates in a counterclockwise direction. The counterclockwise rotation of the second linkage cam 124(*b*) causes the push rod 130, which is attached to bottom right of the second linkage cam 128(*b*), to move upward.

Mounted to a frame 136 above the sliding door panels 102(*a*), 102(*b*), is a lock assembly 132 (FIG. 3). The lock assembly 132 is configured to lock the sliding door panels 102(*a*), 102(*b*) when the sliding door panels 102(*a*), 102(*b*) are in a closed position. The lock assembly 132 typically includes a release block 134, which when activated unlocks the lack assembly 132 and allows the sliding door panels 102(*a*), 102(*b*) to open. In one embodiment, the release block 134 is activated by being displaced (pushed) by the push rod 130. Displacement of the release block 134 may activate a solenoid that disengages the lock assembly. In one embodiment, the lock assembly 132 may take the form of the device disclosed and illustrated in application Ser. No. 12/467,154, hereby incorporated by reference in its entirety.

Operation of the dual release apparatus 104(*a*), 104(*b*) will now be discussed in more detail. To manually operate the lock assembly 132 and unlock the sliding door panels 102(*a*), 102(*b*), either of the first or second handle assemblies 106(*a*), 106(*b*) may be independently operated. That is, the operation of either of the first or second handle assemblies 106(*a*), 106(*b*) does not effect the other handle assemblies 106(*a*), 106(*b*).

In the illustrated embodiment, the handle assemblies 106(*a*), 106(*b*) are operated by linearly sliding the handles 108(*a*), 108(*b*) from a first, rest position to a second, unlock position. Sliding the handles 108(*a*), 108(*b*) (e.g., to the left in FIG. 15) against the bias of spring 118(*a*), 118(*b*)) causes the connection rods 114(*a*), 114(*b*) to move about an arc in the lower arcuate slot 112(*l*) (FIG. 15). The elongated slots 113(*a*), 113,(*b*) in the back of the handles 108(*a*), 108(*b*) accommodate the vertical motion of the connection rods 114(*a*), 114(*b*) as the connection rods 114(*a*), 114(*b*) move about the arc in the lower arcuate slot 112(*l*). Because the connection rods 114(*a*), 114(*b*) are connected mounted off the center of the handle cams 110(*a*), 110(*b*), the handle cams 110(*a*), 110(*b*) are forced to rotate. In the illustrated embodiment, the rotation of the first or second handle cams 110(*a*), 110(*b*) (clockwise as seen if FIG. 15 and counterclockwise as seen in FIG. 16.) pulls downward on the first or second vertical linkages 122(*a*), 122(*b*), causing rotation of the first or second linkage cam 124(*a*), 124(*b*) in a counterclockwise direction. The illustrated embodiment is for a "left-handed" configuration. That is, configured for the left sliding door panel 102(*b*) as illustrated for example in FIG. 1 (platform view). Note however, from the train view, FIGS. 2 and 4, the rotational directions are reversed—that is clockwise appears counterclockwise and vice versa. For the right sliding door panel 102(*b*), the components of the second dual release apparatus 104(*b*) are the same as the first dual release apparatus 104(*a*), however the configuration is minor image. That is, the cams 110(*a*), 110(*b*), 124(*a*), 124(*b*) are configured to rotate in a clockwise direction (FIG. 1, platform view). Note, however, the direction of rotation can be changed, as the direction of rotation is function of which side of the cam a linkage is connected to.

Rotation of either of the first or second vertical linkage cams 124(*a*), 124(*b*) causes the horizontal linkage to move in a horizontal direction. Because the vertical linkages 122(*a*), 122(*b*) are connected to the linkage cams 124(*a*), 124(*b*) via linear slots 123(*a*), 123(*b*), operation of either of the first or second handle assemblies 106(*a*), 106(*b*) does not effect the other handle assembly 106(*a*), 106(*b*). For example, if the first handle assembly 106(*a*) is activated, causing the first linkage cam 124(*a*) to rotate counterclockwise and pull the horizontal linkage 128 to the left (as viewed in FIGS. 17, 19 and 20), the horizontal linkage causes the second linkage cam 124(*b*) to rotate, however, the rod connecting the second linkage cam 124(*b*) to the horizontal linkage 128 merely slides downward in the linear slot 123(*b*) in the second vertical linkage 122(*b*). Thus, the second handle assembly 106(*b*) is not activated. In a similar fashion, if the second handle assembly 106(*b*) is activated, movement of the horizontal linkage 128 merely causes the rod connecting the first linkage cam 124(*a*) to the horizontal linkage 128 to slide downward in the linear slot 123(*a*) in the second vertical linkage 122(*b*).

Regardless of whether the first or second handle 108(*a*), 108(*b*) is operated, the second linkage cam 124(*b*) rotates, causing the push rod 130 to move in a vertical direction. The push rod 130 is configured to contact perturb the release block 134 of the lock assembly 132. The perturbation of release block 134 activates a release mechanism in the lock assembly 132 which unlocks the lock assembly.

FIG. 9 illustrates another embodiment similar to the embodiment illustrated in FIGS. 6-8, 17-19. The embodiment illustrated in FIG. 8, however, is the mirror image of the embodiment illustrated in FIG. 5-7. That is, if the embodiment illustrated in FIGS. 5-7 is arbitrarily denoted as "left handed" (having a handle that slides right to left), the embodiment illustrated in FIG. 8 may be denoted as "right handed" (having a handle that slides left to, right). Note, however, as discussed above, "right handed" and "left handed" are arbitrary designations. Further, depending on how the linkages are connected to the cams, the cams can be made to rotate either clockwise or counterclockwise. Additionally, as noted above, "clockwise" and "counterclockwise" also depend on the vantage, platform or train, of the viewer.

Figure 21:
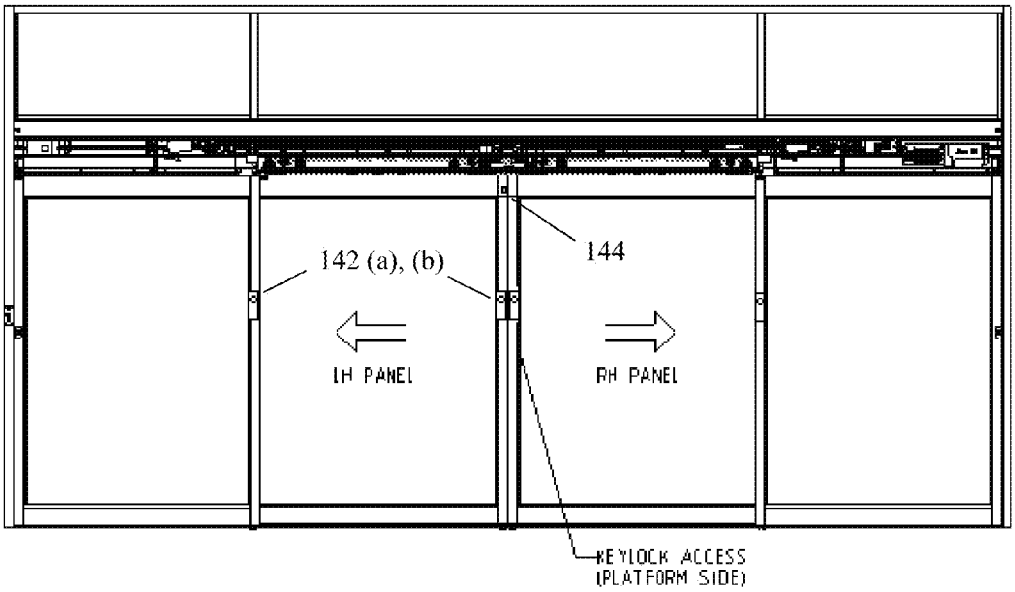
FIG. 21 is a schematic view of another embodiment of the invention.

FIG. 21 illustrates an alternative embodiment of the invention. In an this embodiment, the handle assemblies 106(*a*), 106(*b*) are replaced with switches 142(*a*),(*b*) and the linkages 122(*a*), 122(*b*), 128 and cams 110 (*a*), 110(*b*), 214,(*a*), 124(*b*) are replaced with a solenoid 144. Throwing the switch send a signal to the solenoid 144. The energized solenoid 144 drives the push rod 130 into the release block 134 of the lock assembly 132, thereby causing the lock assembly 132 to unlock the sliding door panels 102(*a*), 102(*b*). Preferably, the switch 142 and the solenoid are energized by batteries. In this way, the sliding door panel 102(*a*), 102(*b*) can be unlocked even in the event of a power failure.

In some aspects of the invention, the system includes a lock sensor 138 configured to determine whether the lock assembly is in an unlocked or lock position. In other aspects, the system includes a door open sensor configured to determine if one or more sliding door panels 102(*a*), 102(*b*) is in an open or closed position.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A system comprising:

a sliding door panel having a first and second side comprising a frame with first and second stiles, the first and second stiles being disposed along opposing vertical edges of the door panel;

a lock having a release mechanism, the lock configured to lock the sliding door panel; and a release assembly comprising first and second release actuators, the first and second release actuators operatively connected to the lock to unlock the lock from the first and second stiles of the sliding door panel, respectively, wherein both the first and second release actuators are positioned on either the first or second side of the door panel, and wherein the first release actuator is on the first stile and the second release actuator is on the second stile.

2. The system of claim 1, wherein the system comprises a plurality of sliding door panels.

3. The system of claim 2, wherein each of the sliding door panels is configured with a release mechanism.

4. The system of claim 1, wherein the first release actuator comprises a first handle and a first vertical linkage operably attached to the first handle, and the second release actuator comprises a second a handle and a second vertical linkage operably attached to the second handle.

5. The system of claim 4, wherein the first vertical linkage is operably attached to the first handle with a first handle cam and the second vertical linkage is operably attached to the second handle with a second handle cam.

6. The system of claim 1, wherein the release assembly is configured to be operated independently from the first and second stiles of the sliding door panel.

7. The system of claim 1, further comprising at least one sensor configured to determine if the panel is unlocked.

8. The system of claim 1, further comprising a sensor to determine if the panel is in an open position.

9. The system of claim 1, wherein the release assembly comprises a first switch adjacent to the first stile of the panel and a second switch adjacent to the second stile of the panel and a solenoid operable connected to the first and second switches and further configured to unlock the lock.

10. The apparatus of claim 4 further comprising a horizontal linkage operably attached to the first and second linkages.

11. The apparatus of claim 10, wherein the first vertical linkage is operably attached to the horizontal linkage with a first linkage cam and the second vertical linkage is operably attached to the horizontal linkage with a second linkage cam.

12. A door panel system comprising:

a slidable panel movable between closed and open positions, the panel comprising a frame with first and second stiles the first and second stiles being disposed along opposing vertical edges of the panel;

a drive motor arranged to move the panel between the open and closed positions; a lock arranged to lock the panel in the closed position; and a release assembly configured to unlock the lock, the release assembly comprising a first manually engageable release actuator on the first stile and a second manually engageable release actuator on the second stile, wherein the first and second manually engageable release actuators are positioned on the same side of the panel.

* * * * *